US010076467B2

(12) United States Patent
Carrel

(10) Patent No.: US 10,076,467 B2
(45) Date of Patent: Sep. 18, 2018

(54) ASSEMBLY FOR COUPLING AN ADAPTOR WITH A MEDICAL CONTAINER

(71) Applicant: Becton Dickinson France, Le Pont de Claix (FR)

(72) Inventor: Franck Carrel, Saint Jean de Vaulx (FR)

(73) Assignee: Becton Dickinson France, Le Pont de Claix (FR)

( * ) Notice: Subject to any disclaimer, the term of this patent is extended or adjusted under 35 U.S.C. 154(b) by 386 days.

(21) Appl. No.: 15/023,578

(22) PCT Filed: Sep. 22, 2014

(86) PCT No.: PCT/EP2014/070148
§ 371 (c)(1),
(2) Date: Mar. 21, 2016

(87) PCT Pub. No.: WO2015/040219
PCT Pub. Date: Mar. 26, 2015

(65) Prior Publication Data

US 2016/0228330 A1 Aug. 11, 2016

(30) Foreign Application Priority Data

Sep. 23, 2013 (EP) ..... 13306293

(51) Int. Cl.
*A61J 1/20* (2006.01)
*A61J 1/14* (2006.01)
*B65D 51/00* (2006.01)

(52) U.S. Cl.
CPC ..... *A61J 1/2055* (2015.05); *A61J 1/1406* (2013.01); *A61J 1/1412* (2013.01); *A61J 1/201* (2015.05); *A61J 1/2096* (2013.01); *B65D 51/002* (2013.01)

(58) Field of Classification Search
CPC ..... A61J 1/20–1/2096; B65D 51/002
See application file for complete search history.

(56) References Cited

U.S. PATENT DOCUMENTS

2012/0192976 A1 8/2012 Rahimy et al.
2015/0013811 A1* 1/2015 Carrel ..... A61J 7/0472 137/798

FOREIGN PATENT DOCUMENTS

WO 2013115728 A1 8/2013
WO 2013115729 A1 8/2013

* cited by examiner

*Primary Examiner* — Benjamin Klein
(74) *Attorney, Agent, or Firm* — The Webb Law Firm

(57) ABSTRACT

An assembly including a connecting member to be mounted on a first medical container, an adaptor including a gripping member to be mounted on a second medical container, a pierceable elastomeric piece, fixed with respect to the gripping member, a protecting envelope comprising a rigid shell substantially surrounding the connecting member and the adaptor in a storage position of the assembly, in which the connecting member is separate from the adaptor. The rigid shell is closed by a removable film. The assembly further comprises a first engagement portion for preventing the connecting member from escaping from the rigid shell when the film is removed. Also, a kit including such an assembly and first and second medical containers.

12 Claims, 7 Drawing Sheets

ASSEMBLY FOR COUPLING AN ADAPTOR WITH A MEDICAL CONTAINER

CROSS-REFERENCE TO RELATED APPLICATIONS

This application is the United States national phase of International Application No. PCT/EP2014/070148 filed Sep. 22, 2014, and claims priority to European Patent Application No. 13306293.5 filed Sep. 23, 2013, the disclosures of which are hereby incorporated in their entirety by reference.

BACKGROUND OF THE INVENTION

Field of the Invention

The present invention relates to an assembly comprising an adaptor capable of being coupled to a medical container the opening of which is defined by a collar. The assembly of the invention allows the coupling of the adaptor with medical containers provided with collars of varying outer diameters. Such medical containers may be vials containing a pharmaceutical product, for which the opening is closed by a septum. For example, the assembly of the invention allows for multiple aseptic needle piercing with an injection device to be filled with part of the product contained in two medical containers of collars of different diameters.

Description of Related Art

In this application, the distal end of a component or apparatus must be understood as meaning the end furthest from the hand of the user and the proximal end must be understood as meaning the end closest to the hand of the user, with reference to the injection device intended to be used with said component or apparatus. As such, in this application, the distal direction must be understood as the direction of injection with reference to the injection device, and the proximal direction is the opposite direction, i.e. the direction of the transfer of the product from the vial to the injection device.

One of the ways to improve health is to immunize entire populations against a number of diseases. To date, injection administration is the most common method of administering vaccines.

From a supply chain perspective, the most efficient vaccine packaging is a multidose container such as multidose vial, that is to say, vial that may contain up to 10, 100 or 1000 doses of vaccine, one dose being intended for one patient. These vials are usually closed by a septum. In preparation of an injection of a vaccine, the user pierces the septum of the vial with the needle of an empty syringe, he then fills the syringe with one dose of vaccine and proceeds to the injection of the vaccine to the patient.

As such, multidose vials imply that the septum of the vial be pierced successively a high number of times, namely as many as the number of doses present in the vial. In order to ensure safe injections, the sterility of both the septum and the inside of the vial should be maintained during the whole time the vial is used.

Anyway, in locations where it is difficult to maintain favorable hygienic conditions such as remote locations which are far from towns and from hospital facilities, the multidose vials may be handled and manipulated at ambiant air and without specific conditions. In such cases, the pharmaceutical product stored in the vial may be contaminated either by the ambiant air sucked each time a dose is removed from the vial, or by contaminants, coming from the outer surface of the septum or the vial, and introduced by the successive piercings with the needle of the empty syringe used.

In addition, in regions where there is limited or potentially no supply of energy to power cooling equipment such as a refrigerator, the multidose vials may be maintained in cold conditions by simple contact with ice packs. As time goes by, part of the ice may melt and turn into water, and the septum of the multidose vials may be in contact with such water that could turn in a favorable medium for bacteria or fungus.

To avoid injecting contaminated pharmaceutical product or vaccine to patients, current medical regulations recommend disposing a vial used in a remote medical program after a certain time period, for example 28 days, even if some pharmaceutical product remains in the vial. Consequently, it may happen that a multidose vial, such as for example a 10-dose vial, is opened and that only three doses are used, for vaccinating three patients only, the remaining content of the vial being wasted because not intended to be administered in a sufficiently short time after opening of the vial in order to guaranty the vaccine or drug sterility.

Vaccination campaigns can therefore be made difficult in some regions and a significant proportion of vaccines may be wasted by the time they reach their target. This has an unacceptable cost to the health organizations in charge of immunization campaigns. In addition, it may happen that in case of vaccination campaigns, or pandemic, hundreds of patients need to be vaccinated in a very short time, in locations where it is difficult to maintain favorable hygienic conditions such as remote locations which are far from towns and from hospital facilities.

Adaptors exist that are to be mounted on the collar of a medical container such as a vial, and that help carrying out the successive piercings of the septum in optimal hygienic conditions. Such adaptors are described in the international application WO2013115728 which is incorporated by reference and is included in the present application. Adaptors according to this document include a gripping member for securing the adaptor on the collar, and a pierceable elastomeric piece, facing the septum when the adaptor is mounted on said collar. As a consequence, introducing the needle of an injection device in the medical container implies that the needle pierces and traverses the elastomeric piece in the first place. During this step, the needle mechanically rubs against the material forming the elastomeric piece and is cleaned, as the potential bacteria are wiped out from the needle when said needle penetrates the elastomeric piece.

The elastomeric piece of the adaptor may prevent or limit potentially contaminated ambient air to be sucked into the vial due to the vacuum resulting of the dose removal. For example, the elastomeric piece may be self-resealing.

In addition, when the collar of the medical device is closed by a septum, once the needle protrudes out of the elastomeric piece of the adaptor, it directly enters the septum of the medical container and may therefore not be contaminated by foreign elements. The needle is not in contact with ambient air when it successively penetrates the pierceable elastomeric piece and then the septum.

The user may repeat the piercing step with the needle of a new empty injection device until all the doses contained in the medical container are removed.

Anyway, depending on the number of doses they contain, all the multidose vials do not have the same dimensions and volume. A 100-doses vial will present bigger dimensions than a 10-doses vial. In particular, the collar of a 100-doses vial will show a bigger outer diameter than the collar of a 10-doses vial. In addition, the volume of a single dose strongly depends on the vaccine and its formulation, and different vaccines may show different dose volumes.

In order to simplify supply-chain of remote medical programs, it would be desirable to provide an adaptor capable of being coupled to medical containers provided with collars of varying outer diameters, rather than having to provide the healthcare worker with two or more different types of adaptors.

Furthermore, the same level of assembly and safety should be maintained regardless the diameter of the collar of the vial used.

Finally, such an adaptor should be obvious to use without any particular training for the user or healthcare worker while maintaining optimal hygienic conditions during assembly.

SUMMARY OF THE INVENTION

A first aspect of the present invention is an assembly comprising:

- a connecting member capable of being axially mounted on a first collar defining an opening of a first medical container, said first collar having an outer diameter D1, said connecting member having an axial through hole for access to said opening of said first medical container, said connecting member having an outer diameter D2, with D1 strictly less than D2,
- an adaptor comprising:
  - a gripping member capable of being laterally mounted on either said connecting member or on a second collar defining an opening of a second medical container, said second collar having an outer diameter D2, said second gripping member having a central hole for access to said opening of said second medical container,
  - a pierceable elastomeric piece, fixed with respect to said gripping member, arranged so as to face said through hole or central hole when said gripping member is mounted on said connecting member or on said second medical container,
- a protecting envelope comprising a rigid shell substantially surrounding said connecting member and said adaptor in a storage position of the assembly, in which the connecting member is separate from the adaptor, said rigid shell being closed by a removable film, wherein said assembly further comprises temporary fixing means for preventing said connecting member from escaping from said rigid shell when said film is removed.

The adaptor and the connecting member of the assembly of the invention are intended to be mounted on medical containers, such as an ampoule, a bottle or a conventional vial for storing pharmaceutical products, in particular multidose vials for vaccines. For sake of simplicity, the present invention will be described with a vial 1 as shown on FIGS. 1A-1C. Such a vial 1 generally comprises a tubular barrel 2 having a longitudinal axis A, closed at an end and having a collar 3 at the opposite end, said collar 3 defining an opening 3*a*, the opening 3*a* being closed by a septum 4 on the example shown. Usually, the septum 4 is fixedly attached to the collar 3 of the vial 1 by a peripheral band 5, said peripheral band 5 leaving a part of the septum 4, herein called outer surface 4*a* of the septum, directly facing the outside of the vial 1, namely the outside environment.

According to the present application, by "outer diameter" of the collar of the medical container intended to be used with the adaptor of the invention, is meant the greatest outer diameter, such as for example the diameter shown as D on FIG. 1B.

The connecting member of the assembly of the invention is intended to be mounted on a medical container, such as a vial of FIGS. 1A-1C having a collar with an outer diameter D1, while the gripping member of the assembly of the invention is intended to be mounted either on said connecting member, or on a medical container, such as a vial of FIGS. 1A-1C having a collar with an outer diameter D2.

When present, the septum 4 is usually made of a material impermeable to gas and liquid and it seals hermetically the content of the vial 1. The septum 4 is also pierceable by the needle of an injection device intended to be filled with the product contained in the vial, said septum 4 being accessible to said needle via its outer surface 4*a*.

The medical containers intended to be used with the assembly of the invention may alternatively have openings closed by a membrane. Alternatively, the medical containers may be free of any septum or closing membrane and the openings may not be closed at all.

Depending on the number of doses it contains, the medical container, such as a vial 1, may show different dimensions. For example, among existing conventional vials, some show an outer diameter of 20 mm and others show an outer diameter of 13 mm.

The assembly of the invention, which comprises a connecting member onto which the gripping member may be laterally mounted, allows to use two at least sorts of medical containers having two different outer diameters, for example D1 and D2. This is particularly valuable in remote medical programs where a high number of medical devices have to be shipped through very poor communication axis.

With the assembly of the invention, a medical container, such as a vial, having a collar of outer diameter D2 may be directly coupled to the gripping member of the adaptor of the assembly of the invention, like in the already existing adaptors. When a medical container having a collar with a smaller outer diameter D1 is required, the assembly of the invention provides a piece, namely the connecting member, allowing the coupling of this medical container having a collar of smaller outer diameter D1, with the same adaptor of the assembly of the invention. Indeed, a medical container with a collar of outer diameter D1 may be mounted onto the connecting member of the assembly of the invention in a first step, said connecting member being then mounted onto the gripping member of the adaptor of the assembly of the invention in a second step. In addition, the connecting member, thanks to the temporary fixing means, may not escape or drop off the envelope of the assembly, when said envelope is being opened, and it therefore cannot be contaminated by falling on the ground. As a consequence, the coupling of a medical container having a collar of outer diameter D1 to the connecting member may take place in excellent hygienic conditions. In addition, thanks to the presence of the protecting envelope, the adaptor of the assembly of the present invention may be mounted on a vial without direct contact between the user's hands and the adaptor.

"Rigid" shell means in accordance with the present application that the shell shows a limited flexibility if a pressure is applied thereon, but does not collapse under its own weight.

In the present application, "pierceable" means that the elastomeric piece, and the septum when present, may be pierced and traversed by the needle of an injection device such as a syringe, an auto-injector, or a reconstitution device, for example for administering a pharmaceutical product such as a drug or a vaccine.

The assembly of the invention allows introducing the needle of an injection device inside two medical containers of collars of different diameters in favorable hygienic conditions multiple successive times. Indeed, when the user decides to fill in an empty syringe with a dose of drug contained in a medical container, he simply mounts the adaptor of the assembly of the invention on the collar of the medical container by means of the gripping member, or by means of both the connecting member and the gripping member, depending on the value of the outer diameter of the collar of the medical container to be used. Once the adaptor is mounted on the collar of the medical container, the pierceable elastomeric piece faces the opening of the medical container.

Then, as seen above, introducing the needle of an injection device into the medical container implies piercing the pierceable elastomeric piece of the adaptor in the first place. During this step, the needle mechanically rubs against the material forming the pierceable elastomeric piece and it is cleaned, as potential bacteria are wiped from the needle when said needle penetrates the pierceable elastomeric piece. In addition, once the needle protrudes out of the elastomeric piece of the adaptor, it directly enters the opening of the medical container and may therefore not be contaminated by foreign elements. Moreover, in embodiments where the pierceable elastomeric piece is self-resealing, no potentially contaminated outside air is sucked into the medical container despite the vacuum resulting from the dose withdrawal.

The user may repeat the piercing step with the needle of a new empty syringe until all the doses contained in the medical container are removed.

In embodiments, said connecting member and said adaptor being laterally spaced from one another within said shell, the temporary fixing means comprise laterally extending ridges located on an inner wall of said shell capable of cooperating with a surface of said connecting member, so that when said removable film is removed, said connecting member is maintained within said shell. The connecting member remains therefore preserved from ambient atmosphere and potential contaminants, even when the envelope is opened after removing the removable film.

In embodiments, said assembly further comprises engagement means for preventing rotation of said connecting member with respect to said gripping member when said gripping member is mounted on said connecting member. The user is therefore assured that the connecting member is correctly assembled and positioned with respect to the gripping member and in particular, with respect to the pierceable elastomeric piece. These engagement means may also prevent removal of a medical container secured in the adaptor and may bring stability to the medical container inside the connecting member and the gripping member.

In embodiments, said engagement means comprise at least a surface located on an outer wall of the connecting member and a corresponding surface located on an inner wall of the gripping member, said surface and corresponding surface being capable of cooperating together for preventing rotation of said connecting member with respect to said gripping member when said gripping member is mounted on said connecting member.

In embodiments, the gripping member is a lateral clipping member comprising a U-shaped element intended to be engaged on said connecting member or on said second collar via the open part of the U-shaped element, the curved part of the U-shaped element partially surrounding said connecting member or second collar.

In embodiments, the connecting member comprises releasable snap-fitting means capable of cooperating with said first collar so as to mount said connecting member on said first collar. For example, the snap-fitting means comprise flexible legs provided on the connecting member, said flexible legs being capable of radially outwardly deflecting at the time said first collar is clipped onto the connecting member, and then of coming back to a rest position in which they secure said collar on said connecting member. Such flexible legs may then be for example manually deflected by the user if necessary, in order to remove said first collar from the connecting member.

In embodiments, the adaptor further comprises locking means for preventing the release of said snap-fitting means once said gripping member is mounted on said connecting member. In embodiments, the locking means are located on the gripping member. For example, when the snap-fitting means are under the form of flexible legs, the locking means may comprise shapes located on the gripping member, said shapes engaging said flexible legs when the gripping member is mounted on the connecting member, so that said legs are no more deflectable.

In embodiments, the elastomeric piece is lodged within a recess designed on the gripping member. In other embodiments, the adaptor further comprises an outer cap substantially surrounding said gripping member, the elastomeric piece being lodged within a recess designed on the outer cap.

In embodiments, the opening of the medical container to be used being closed by a septum, said septum having an outer surface directed towards the outside of the medical container, the elastomeric piece is designed so as to be in contact with the outer surface of the septum when said adaptor is mounted on said collar.

Preferably, the elastomeric piece has a design, shape, and location on the adaptor, allowing a part of it to be in contact, in particular in close contact, with the outer surface of the septum when said adaptor is on mounted on a collar the opening of which is closed by a septum.

In such embodiments, the adaptor of the assembly of the invention then allows piercing the septum of the medical container in excellent hygienic conditions multiple successive times. Indeed, when the user decides to fill in an empty syringe with a dose of drug contained in a medical container, he simply mounts the adaptor of the invention on the collar of the medical container by means of the gripping member, or by means of both the connecting member and the gripping member, depending on the value of the outer diameter of the collar of the medical container to be used. Once the adaptor is mounted on the collar of the medical container, the pierceable elastomeric piece of the adaptor is in contact, for example in tight contact, with the outer surface of the septum of the medical container.

In embodiments, the surface of the elastomeric piece is complementary to the whole outer surface of the septum. As such, whatever the piercing location of the elastomeric piece of the adaptor by the needle, the user is ensured that the distal tip of the needle will directly pierce the septum after being passed through the elastomeric piece. Therefore, said distal tip is not in contact with ambient air or with other elements that would be trapped between the outer surface of the septum and the surface of the elastomeric piece. In particular, in such embodiments, the outer surface of the septum and the complementary surface of the elastomeric piece match each other in such a way that they are in intimate contact together on their entire surface and lead to a closed, air-tight interface.

In embodiments, the outer cap may be designed so as to press said elastomeric piece onto said outer surface of the septum, when said adaptor is mounted on a collar closed by a septum. Such embodiments ensure that the outer surface of the septum and the complementary surface of the elastomeric piece are in tight contact together and that no ambient air is trapped between the outer surface of the septum and the complementary surface of the elastomeric piece. The distal tip of the needle may not enter in contact with other elements than the elastomeric piece and the septum when it successively traverses the elastomeric piece and the septum. Furthermore, the interface between the septum and the elastomeric piece is now sealed :no ambient air can be sucked into the medical container when the needle is removed from the elastomeric piece and the medical container septum.

In embodiments, the assembly further comprises a fixing system for preventing releasing of said gripping member from said connecting member or said second collar. The fixing system may comprise snap-fitting means. Such embodiments ensure that the adaptor is not separated from the medical container. The excellent hygienic conditions of the medical container are therefore maintained.

Another aspect of the invention is a kit comprising an assembly as described above, a first medical container provided with a first collar of outer diameter D1 and a second medical container provided with a second collar of outer diameter D2. In embodiments, the first collar and the second collar are both closed by a septum.

A further aspect of the present invention is an assembly comprising:

- a connecting member adapted to be axially mounted on a first collar defining an opening of a medical container, the first collar having an outer diameter D1, the connecting member having an axial through hole for access to the opening of the medical container, the connecting member having an outer diameter D2, with D1 less than D2,
- an adaptor comprising:
  - a gripping member adapted to be laterally mounted on the connecting member, the gripping member having a central hole for access to the through hole of the connecting member,
  - a pierceable elastomeric piece, fixed with respect to the gripping member, arranged so as to face the through hole when the gripping member is mounted on the connecting member,
- a protecting envelope comprising a rigid shell substantially surrounding the connecting member and the adaptor in a storage position of the assembly, in which the connecting member is separate from the adaptor, the rigid shell being closed by a removable film,
- wherein the assembly further comprises a first engagement portion for engaging the connecting member and preventing the connecting member from escaping from the rigid shell when the film is removed.

The connecting member and the adaptor may be laterally spaced from one another within the shell and the first engagement portion may comprise laterally extending ridges located on an inner wall of the shell adapted to cooperate with the surface of the connecting member, so that when the removable film is removed, the connecting member is maintained within the shell.

The assembly may further comprise a second engagement portion for preventing rotation of the connecting member with respect to the gripping member when the gripping member is mounted on the connecting member. The second engagement portion may comprise at least one first surface located on an outer wall of the connecting member that engages at least one corresponding second surface located on an inner wall of the gripping member, the at least one first surface and at least one corresponding second surface being capable of cooperating together for preventing rotation of the connecting member with respect to the gripping member when the gripping member is mounted on the connecting member.

The gripping member may be a lateral clipping member comprising a U-shaped element adapted to engage the connecting member via the open part of the U-shaped element, the curved part of the U-shaped element partially surrounding the connecting member.

The connecting member may comprise at least one releasable snap-fitting member adapted to cooperate with the first collar so as to mount the connecting member on the first collar and may include at least one locking member for preventing the release of the at least one snap-fitting member once the gripping member is mounted on the connecting member. The at least one locking-member may be located on the gripping member.

The elastomeric piece may be lodged within a recess on the gripping member.

The adaptor may further comprise an outer cap substantially surrounding the gripping member, wherein the elastomeric piece is lodged within a recess on the outer cap.

A further aspect of the present invention is a kit comprising an assembly as described above, a first medical container provided with a first collar of outer diameter D1 and a second medical container provided with a second collar of outer diameter D2. The first collar and the second collar may both be closed by a septum.

A still further aspect of the present invention is an assembly comprising:

- a connecting member adapted to be axially mounted on a first collar defining an opening of a first medical container, the first collar having an outer diameter D1, the connecting member having an axial through hole for access to the opening of the first medical container, the connecting member having an outer diameter D2, with D1 less than D2,
- an adaptor comprising:
  - a gripping member adapted to be laterally mounted on a second collar defining an opening of a second medical container, the second collar having an outer diameter D2, the gripping member having a central hole for access to the opening of the second medical container,
  - a pierceable elastomeric piece, fixed with respect to the gripping member, arranged so as to face the central hole when the gripping member is mounted on the second medical container,
- a protecting envelope comprising a rigid shell substantially surrounding the connecting member and the adaptor in a storage position of the assembly, in which the connecting member is separate from the adaptor, the rigid shell being closed by a removable film,
- wherein the assembly further comprises a first engagement portion for engaging the connecting member and preventing the connecting member from escaping from the rigid shell when the film is removed.

The gripping member may be a lateral clipping member comprising a U-shaped element adapted to engage the second collar via the open part of the U-shaped element, the curved part of the U-shaped element partially surrounding the second collar.

DESCRIPTION OF THE INVENTION

Figure 1A:
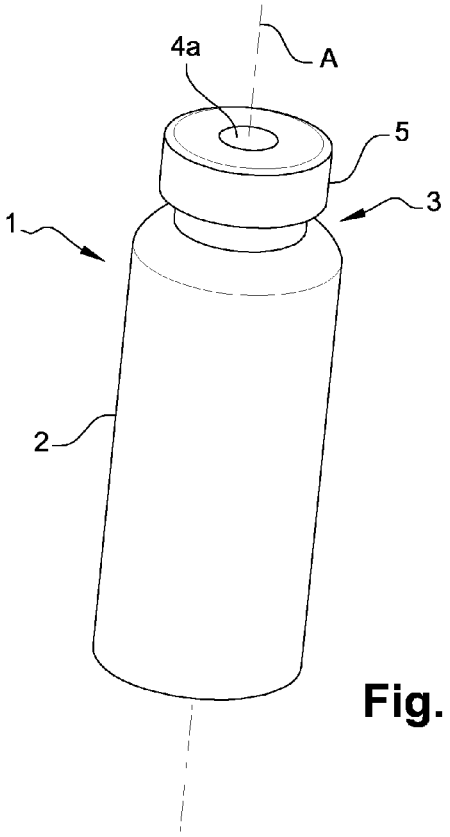
FIG. 1A is a perspective view of a vial on which the gripping member and/or the connecting member of the assembly of the invention is to be mounted.
Figure 1B:
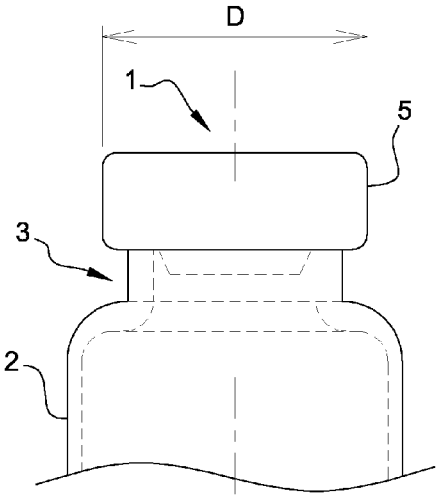
FIG. 1B is a partial side view of a vial on which the gripping member and/or the connecting member of the assembly of the invention is to be mounted.
Figure 1C:
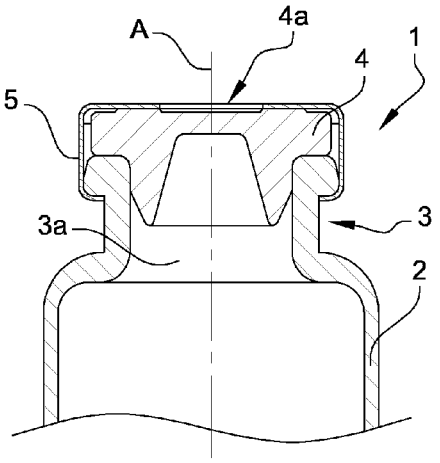
FIG. 1C is a partial cross section view of a vial on which the gripping member and/or the connecting member of the assembly of the invention is to be mounted.
Figure 2:
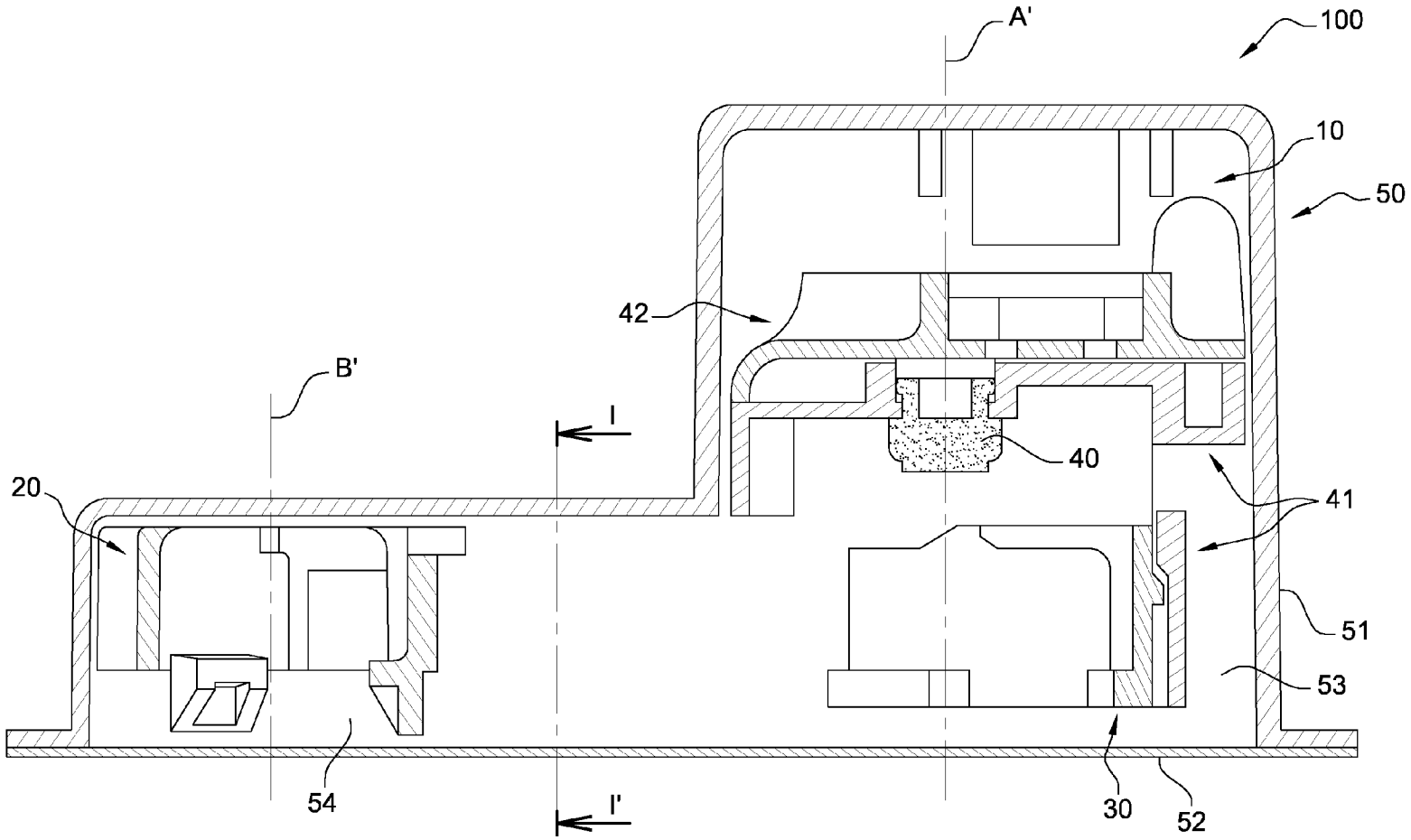
FIG. 2 is a cross section view of an embodiment of the assembly of the invention in the storage position.

With reference to FIG. 2 is shown an assembly 100 in accordance with an embodiment of the invention, in a storage position. The assembly 100 comprises a connecting member 20 and an adaptor 10 intended to be coupled to a collar of a medical container such as a vial of FIGS. 1A-1C, along a longitudinal axis A' (see FIG. 2), in alignment of longitudinal axis A of the medical container. The assembly 100 further comprises a protecting envelope 50 surrounding the connecting member 20 and the adaptor 10. The adaptor 10 is capable of being coupled to collars of two different outer diameters, such as D1 and D2, with D1 strictly less than D2, if necessary by means of the connecting member 20. The adaptor 10 comprises a gripping member 30 and a pierceable elastomeric piece 40.

The elastomeric piece 40 may be made of a material impermeable to gas and liquid capable of flexing under pressure. For example, the elastomeric piece has a thickness ranging from 1 to 8 mm, preferably from 2 to 4 mm. The elastomeric piece may show a hardness ranging from 10 to 100 Shore A, preferably from 40 to 70 Shore A, measured according to DIN 53505.

Suitable materials for the elastomeric piece 40 of the adaptor of the invention include natural rubber, acrylate-butadiene rubber, cis-polybutadiene, chlroro or bromobutyl rubber, chlorinated polyethylene elastomers, polyalkylene oxide polymers, ethylene vinyl acetate, fluorosilicone rubbers, hexafluoropropylene-vinylidene fluoride-tetrafluoroethylene terpolymers, butyl rubbers, polyisobutene, synthetic polyisoprene rubber, silicone rubbers, styrene-butadiene rubbers, tetrafluoroethylene propylene copolymers, thermoplastic-copolyesters, thermo-plastic elastomers, or the like or a combination thereof.

Preferably, the elastomeric piece is self-resealing and it automatically seals the hole produced by the piercing of the needle, automatically and rapidly, for example in less than 0.5 seconds, once the needle is removed from the elastomeric piece. This automatic closure step may occur a high number of times, in particular as many times as required for removing the numerous doses of product initially present in the multidose vial 1. Suitable materials for self-resealing elastomeric piece of the adaptor of the invention include synthetic polyisoprene, natural rubber, silicone rubber, thermo-plastic elastomers, or the like or a combination thereof.

In embodiments, the elastomeric piece may further comprise a material including antiseptic agents, such as silver ions or copper ions. For example, silver salt or copper salt may be covalently linked to a polymer matrix present in the material comprised in the elastomeric piece. Alternatively, silver salts or copper salts may be introduced as a load during the manufacturing of the polymer present in the material comprised in the elastomeric piece. For example, the polymer matrix may be selected from silicone rubber, butyl rubber and/or halogenobutyl rubber. In embodiments, the elastomeric piece comprises a material comprising a silicone rubber including silver ions: such products are commercially available from the company Momentive Performance Materials under the tradenames "Statsil®" or "Addisil®". In embodiments, the elastomeric piece may consist in a material including silver ions, such as silicone rubber including silver ions. In other embodiments, the elastomeric piece may consist in a material including copper ions.

Elastomeric pieces of the adaptor of the assembly of the invention, comprising a material including antiseptic agents, such as silver ions or copper ions, show antiseptic and hydrophobic properties. The growth of bacteria is therefore directly prevented at the surface of the elastomeric piece. Moisture formation is also prevented, thereby further reducing the growth of bacteria. As a consequence, when a needle pierces an elastomeric piece of the adaptor of the invention comprising a material including antiseptic agents, such as silver ions or copper ions, in view of entering a vial for removing a dose of product from said vial, the risk of contamination of the vial content is reduced.

Alternatively or in combination, the elastomeric piece may comprise a coating comprising an antiseptic agent, such as chlorhexidine di-acetate. For example, the elastomeric piece may comprise a butyl rubber or a halogenobutyl rubber coated with a coating comprising chlorhexidine di-acetate. Such a coating may be obtained by UV cross-linking. The antiseptic action of such a coating may occur within minutes and such a coating may therefore be able to clean a contaminated needle during its insertion within the elastomeric piece.

For example, a solution of chlorhexidine di-acetate may be applied on the elastomeric piece before being submitted to UV cross-linking. Such kind of coatings are very interesting as they have fast kinetic (within minutes) and therefore can clean a needle during its insertion within the elastomeric piece.

In embodiments not shown, the elastomeric piece is lodged within a recess designed in the gripping member 30.

In the example shown, the adaptor 10 further comprises an outer cap 41, substantially surrounding the gripping member 30, and a cover 42 located on top of the outer cap 41. As will appear from the description below, the outer cap 41 and the cover 42 are optional pieces of the adaptor of the assembly of the invention. Although the embodiment described in the following description comprises such an outer cap 41 and such a cover 42, the assembly of the invention may not contain such elements.

In the storage position of the assembly 100, as shown in FIG. 2, the gripping member 30, the elastomeric piece 40, the outer cap 41 and the cover 42 are aligned on longitudinal axis A', while the connecting member 20 is aligned on longitudinal axis B', parallel to longitudinal axis A', but laterally spaced with respect to longitudinal axis A' along a lateral direction called L.

In the example shown, the elastomeric piece 40 is lodged in a central hole of the outer cap 41 in which it remains fixed by friction and/or snap-fitting means (not shown). The elastomeric piece 40 has globally the shape of a flat cylinder. In embodiments where the vial 1 to be coupled to the adaptor 10 comprises a septum, the elastomeric piece 40 may have a surface which is complementary to that of the septum 4, so that this surface is tightly and intimately in contact with the outer surface 4*a* of the septum 4 once the vial is coupled to the adaptor 10. No foreign elements may be present between the distal face of the elastomeric piece 40 and the outer surface 4*a* is cleaned and protected. In the embodiments where the elastomeric piece 40 is self-resealing, a tight and intimate contact with the outer surface 4*a* of the septum 4 also allows preventing potentially contaminated ambient air to be sucked into the vial after each dose removal.

The outer cap 41 is attached to the gripping member 30 by fixing means such as snap-fitting means (not shown). In embodiments not shown, the outer cap 41 and the gripping member 30 are made as a single part. The cover 42 is rotationally attached to the outer cap 41 and is useful for protecting the elastomeric piece 40 during the storage of the adaptor 10.

For clarity's sake, in the present description, a "front" side and a "rear" side of the connecting member, the gripping member and of the adaptor in general will be defined, as respectively the parts directed to the left of FIG. 2 for the "front" side, and the parts directed to the right of FIG. 2, for the "rear" side.

In its storage position as shown on FIG. 2, the assembly 100 further comprises a protecting envelope 50 surrounding the connecting member 20, and the adaptor 10, namely the gripping member 30, the elastomeric piece 40, the outer cap 41 and the cover 42. The protecting envelope 50 includes a rigid shell 51 and a removable film 52.

Figure 3A:
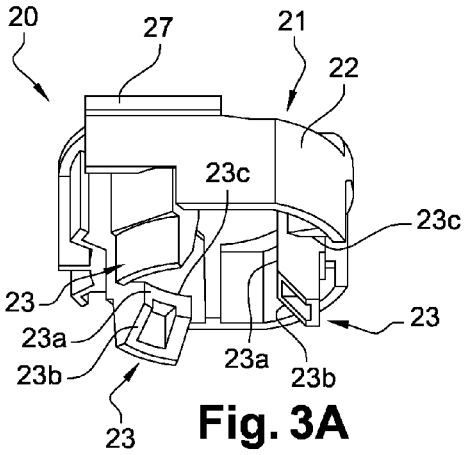
FIG. 3A is a perspective view of the connecting member of the assembly of FIG. 2.
Figure 3B:
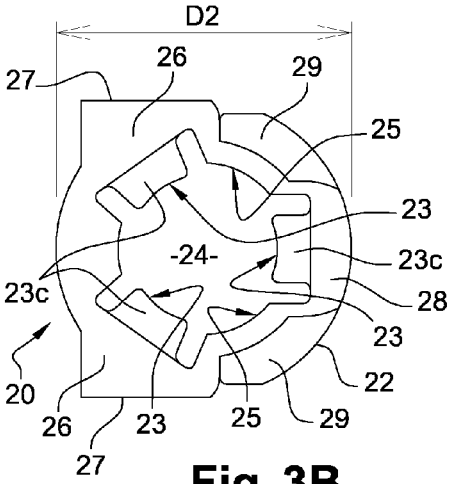
FIG. 3B is a top view of the connecting member of the assembly of FIG. 2.
Figure 3C:
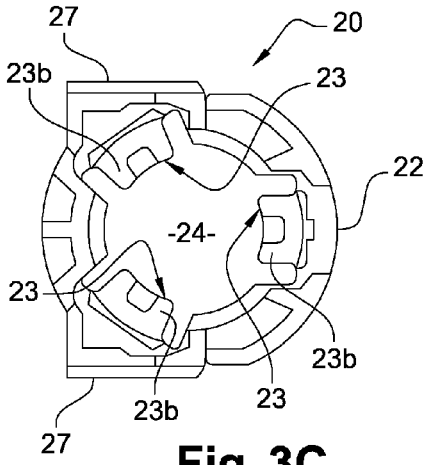
FIG. 3C is a bottom view of the connecting member of the assembly of FIG. 2.

With reference to FIGS. 3A-3C, the connecting member 20 will now be described in detail. The connecting member 20 comprises a ring 21, having a partially tubular wall 22 showing a height suitable for surrounding the collar 3 of a first vial 1*a* (see FIG. 8) of outer diameter D1. The tubular wall 22 globally defines a through hole 24 having a diameter slightly greater than D1, so that the collar 3 of a first vial 1*a* of outer diameter D1 may be received inside said through hole 24. In the example shown, the tubular wall 22 is provided with three distally extending legs 23 which are radially outwardly deflectable, regularly distributed along the circumference of the tubular wall 22. In other embodiments not shown, only two distally extending flexible legs, or on the contrary more than three such legs, like four or five legs, may be present. With reference to FIGS. 3A-3C, each distally extending leg 23 is provided with an inner rim 23*a* provided with a distal tapered face 23*b* and a proximal face 23*c*. As will appear later from the description below, the three distally extending flexible legs 23 allow an axial clipping of the ring 21, and therefore of the connecting member 20, onto a collar 3 of outer diameter D1. In its proximal region, the tubular wall 22 is further provided with a plurality of partial ridges forming an annular rim 25. The annular rim 25 is further provided in the front part of the ring 21 with two transversal surfaces 26 defining two opposite parallel ridges 27 aligned on the lateral direction. The ring 21 is further provided in its rear part with a transversal surface 28 and two shoulders 29, each located on a side of said transversal surface 28.

In addition, in its circular rear part, the ring 21 defines an outer diameter corresponding to diameter D2.

Figure 4A:
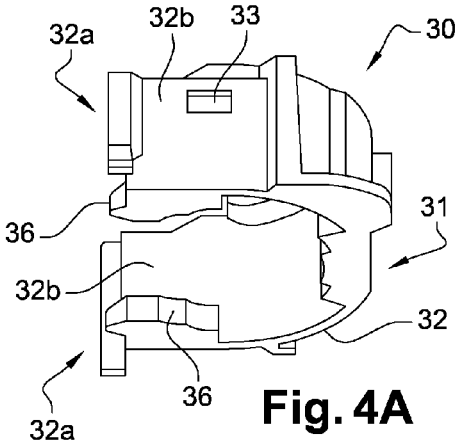
FIG. 4A is a perspective view of the gripping member of the adaptor of the assembly of FIG. 2.
Figure 4B:
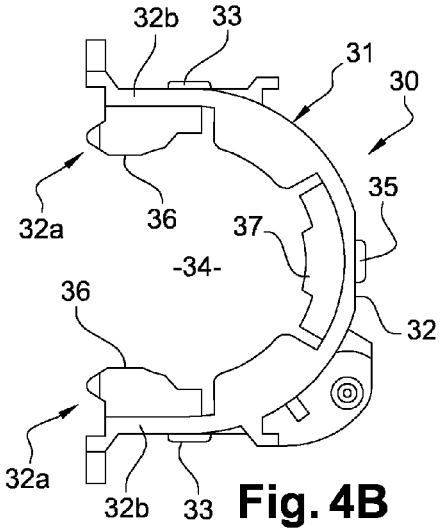
FIG. 4B is a top view of the gripping member of the adaptor of the assembly of FIG. 2.
Figure 4C:
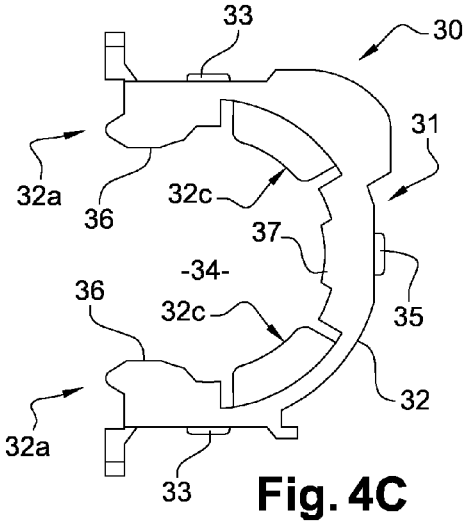
FIG. 4C is a bottom view of the gripping member of the adaptor of the assembly of FIG. 2.

With reference to FIGS. 4A-4C, the gripping member 30 will now be described in detail. The gripping member 30 is a lateral gripping member and comprises a U-shaped body 31, having a partially tubular wall 32 showing a height suitable for surrounding the collar 3 of a second vial 1*b* (see FIGS. 1A-1C), this time of outer diameter D2, with two lateral walls 32*b* terminated by front free ends 32*a* corresponding to the ends of the branches of the U, the U-shaped body 31 therefore forming a clipping member. The partially tubular wall 32 further defines a central hole 34 having a diameter slightly greater than D2, so that a collar 3 of outer diameter D2, or the connecting member 20, may be received inside the hole 34 (see FIGS. 5A and 5B). Close to each free end 32*a*, the tubular wall 32 is provided on its outer surface with a peg 33. In its circular portion, the partially tubular wall 32 is further provided on its outer surface with a rear projection 35, and on its inner surface with a front projection 37. The partially tubular wall 32 is further provided with two curved rims 32*c* extending inwardly, one on each side of said front projection 37. Each free end 32*a* is further provided with a front projection forming a radial rim 36.

Figure 5A:
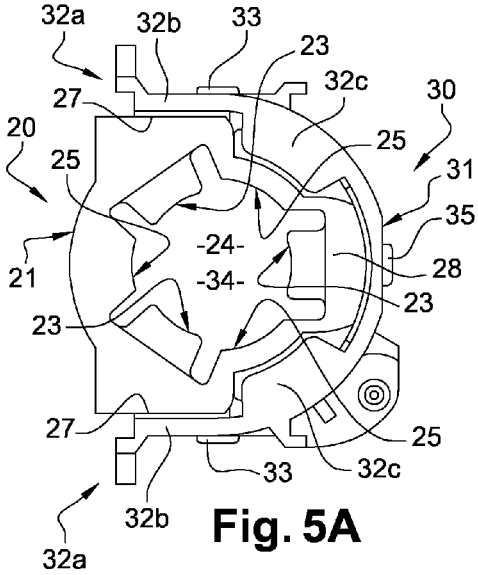
FIG. 5A is a top view of the gripping member mounted and secured on the connecting member of the assembly of FIG. 2.
Figure 5B:
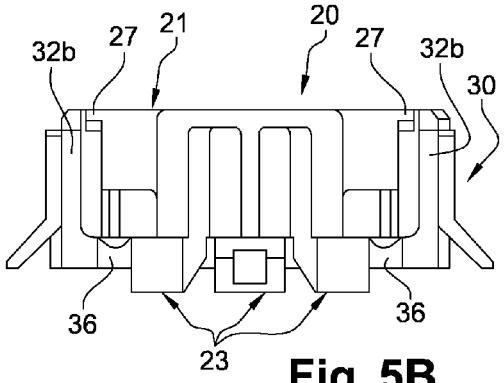
FIG. 5B is a side view of the gripping member mounted and secured on the connecting member of the assembly of FIG. 2.
Figure 5C:
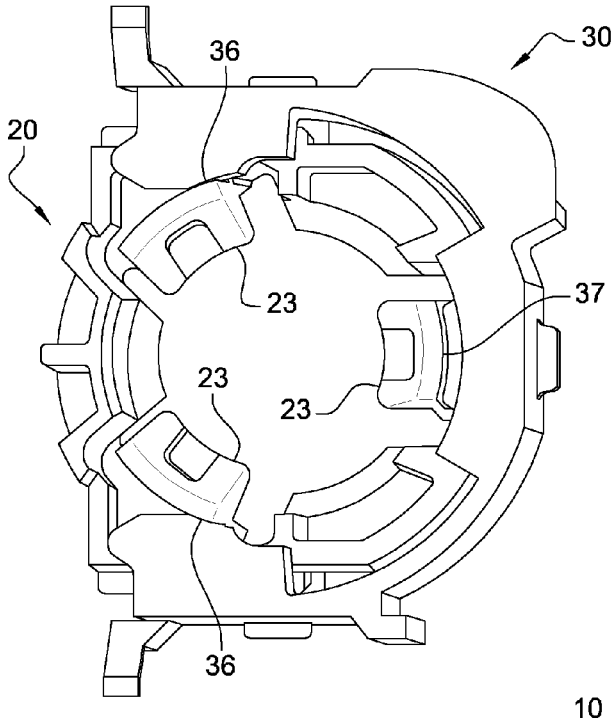
FIG. 5C is a bottom view of the gripping member mounted and secured on the connecting member of the assembly of FIG. 2.

With reference to FIGS. 5A-5C, the gripping member 30 may be mounted onto the connecting member 20. In such a position, the circular rear part of the ring 21 is received within the central hole 34 defined by the partially tubular wall 32 of the U-shaped body 31, as shown on FIG. 5A. In addition, in such a position, the parallel ridges 27 of the ring 21 are in abutment against the lateral walls 32*b* of the U-shaped body 31 of the gripping member 30, the transversal surface 28 of the connecting member 20 is engaged between the curved rims 32*c* of the gripping member 30. Indeed, as shown in FIG. 5A, the transversal surface 28 and the curved rims 32*c* have complementary shapes. In addition, each shoulder 29 (FIG. 3B) of the connecting member 20 faces a curved rim 32*c* of the gripping member 30. Because of the engagement of the complementary shapes of the transversal surface 28, the curved rims 32*c* and the shoulders 29, the connecting member 20 is locked in rotation with respect to the gripping member 30. The mounting of the gripping member 30 onto the connecting member 20 is only possible in the particular arrangement shown in FIGS. 5A, 5B and 5C. The parallel ridges 27, the transversal surface 28 and the shoulder 29 of the ring 21, together with the lateral walls 32*b* and the curved rims 32*c* of the U-shaped body 31 therefore form engagement means for preventing rotation of the connecting member 20 with respect to the gripping member 30 around their respective longitudinal axis. In addition, these engagement means ensure the correct position of the connecting member 20 with respect to the gripping member 30.

With reference to FIG. 5B, when the gripping member 30 is mounted onto the connecting member 20, the distal end 22*a* of the tubular wall 22 is in distal abutment against the radial rims 36 of the gripping member 30. In embodiments, the gripping member 30 may be secured to the connecting member 20 in a permanent way.

In addition, with reference to FIG. 5C, in the position where the gripping member 30 is mounted onto the connecting member 20, the distal end of each distally extending leg 23 of the connecting member 20 abuts onto a surface of the gripping member 30, either one of the radial rims 36 or the front projection 37, the reason of which will be explained later.

Figure 6:
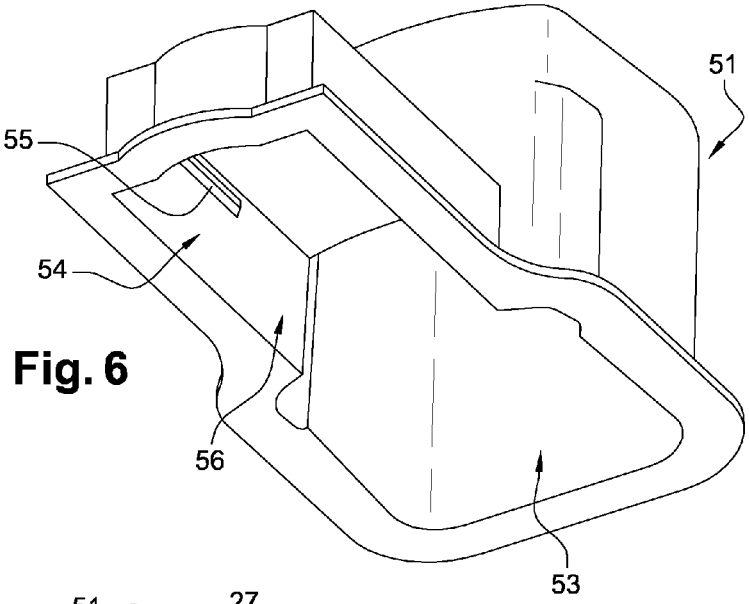
FIG. 6 is a perspective view of the protecting envelope of the assembly of FIG. 2.
Figure 7:
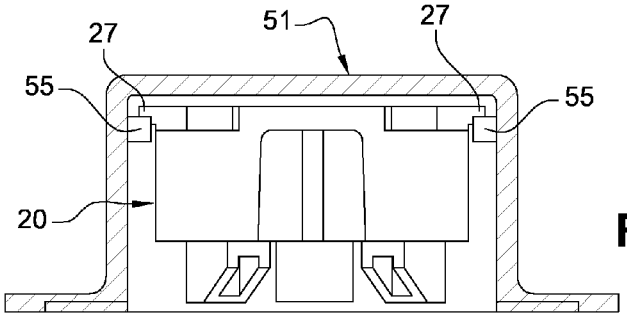
FIG. 7 is a cross section view taken along line I-I' of FIG. 2.

With reference to FIG. 6, the rigid shell 51 of the protecting envelope 50 will now be described in detail. "Rigid" shell means in accordance with the present application that the shell shows a limited flexibility if a pressure is applied thereon, but does not collapse under its own weight. For example, the shell is made of a thermoplastic material.

As shown on FIGS. 2 and 6, the rigid shell 51 has a three dimensional shape allowing it to surround the connecting member 20 and the adaptor 10, namely the gripping member 30, the elastomeric piece 40, the outer cap 41 and the cover 42 in the example shown. The rigid shell 51 serves as a protection element of the connecting member 20 and of the adaptor 10, in the storage position of the assembly 100.

In embodiments where the outer cap and the cover are not present, the rigid shell 51 has a three dimensional shape allowing it to surround the connecting member 20, the gripping member 30 and the elastomeric piece 40.

With reference to FIG. 6, the rigid shell 51 comprises a rear lodging 53 capable of receiving the adaptor 10, and a front lodging 54 capable of receiving the connecting member 20. Two proximal ridges 55 extending laterally from the front end towards the rear end of the rigid shell 51, on a determined distance only, only one being visible on FIG. 6, are provided, one on each lateral wall of the front lodging 54. Between the rear lodging 53 and the front lodging 54 is provided a central lodging 56, the inner wall of which is free of any ridges.

The use of the assembly 100 in connection with a first vial 1*a* of FIGS. 1A-1C with a collar 3 having an outer diameter D1 and with a second vial 1*b* of FIGS. 1A-1C with a collar 3 having an outer diameter D2 will now be explained with reference to FIGS. 2-12.

The assembly 100 is provided to the user in its storage position as shown on FIG. 2, with the connecting member 20 and the adaptor 10, namely the gripping member 30, the elastomeric piece 40, the outer cap 41 and the cover 42 in the example shown, imprisoned into the protecting envelope 50.

In such a storage position, the rigid shell 51 is closed by the removable film 52. The adaptor 10, namely the gripping member 30, the elastomeric piece 40, the outer cap 41 and the cover 42 in the example shown, are lodged within the rear lodging 53. The connecting member 20 is lodged within the front lodging 54 of the rigid shell 51. As shown on FIG. 7, in the storage position of the assembly 100, the ridges 27 of the ring 21 of the connecting member 20 are in distal abutment onto the laterally extending proximal ridges 55 of the front lodging 54 of the rigid shell 51.

Once the user is ready to proceed to the withdrawal of a dose of product contained in a vial (1*a*, 1*b*) having a collar of outer diameter D1 or D2, he first removes the removable film 52 in order to open the protecting envelope 50. During this step, thanks to the fact that the ridges 27 of the ring 21 of the connecting member 20 are in distal abutment onto the laterally extending proximal ridges 55 of the rigid shell 51, the connecting member 20 remains attached to the rigid shell 51 and does not drop off on the ground. This especially prevents users from using contaminated connecting members which may carry contamination to the interface between the elastomeric piece 40 and the opening 3, and septum 4 of the medical container, if present. The handling of the connecting member 20 is therefore possible in excellent hygienic conditions.

Anyway, the connecting member 20 is not definitively fixed to the rigid shell 51. Indeed, the user may detach the connecting member 20 from the rigid shell 51 by sliding the ring 21 laterally towards the gripping member 30 until the ridges 27 escape from the proximal ridges 55. As a consequence, the ridges 27 of the connecting member 20 and the proximal ridges 55 of the rigid shell 51 form temporary fixing means for preventing the connecting member 20 from escaping from the rigid shell 51 when the film 52 is removed.

The use of the assembly 100 in connection with a first vial 1*a* of FIGS. 1A-1C with a collar 3 having an outer diameter D1 will now be explained with reference to FIGS. 2-9.

Figure 8:
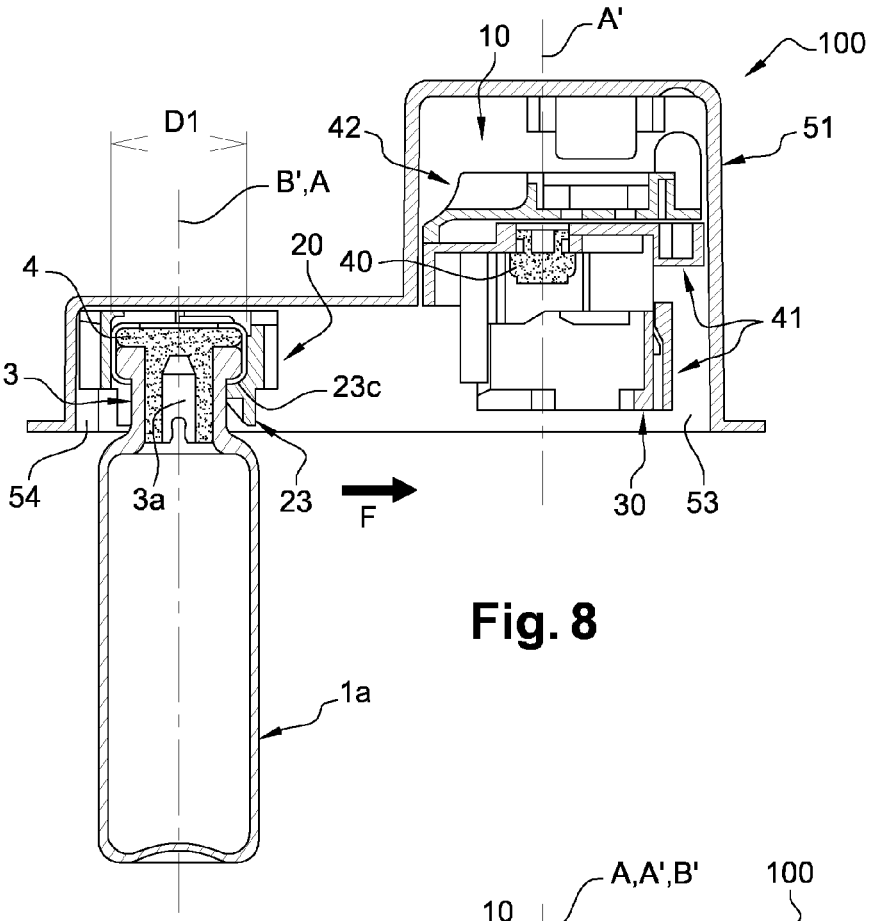
FIG. 8 is a cross section view of the assembly of FIG. 2 once the film of the envelope has been removed and with the connecting member mounted on a vial of outer diameter D1.

Once the user has removed the film 52 from the protecting envelope 50, he seizes the first vial 1*a* provided with a collar 3 having an outer diameter D1. The connecting member 20 is still lodged into the front lodging 54 of the rigid shell 51, thanks to the ridges 27 being in distal abutment onto the proximal ridges 55, as explained above in reference to FIG. 7. The user then directs the collar 3 of the first vial 1*a* in the proximal direction towards the distal end of the ring 21 of the connecting member 20. The collar 3 comes in contact with the distal tapered faces 23*b* of the distally extending legs 23 of the connecting member 20. As the user continues pushing the first vial 1*a* in the proximal direction, the distally extending legs 23 deflect radially outwardly and the collar 3 of the first vial 1*a* reaches the through hole 24 defined by the ring 21, until it gets engaged therein, as shown in FIG. 8. In the position shown in this Figure, the connecting member 20 is mounted onto the collar 3 of the first vial 1*a*, with the distal end of the collar 3 in distal abutment on the proximal faces 23*c* of the distally extending legs 23, and the proximal end of the collar 3 in proximal abutment onto the annular rim 25 of the tubular wall 22. The connecting member 20 is nevertheless for the moment releasably secured onto the collar 3 of the first vial 1*a*. Indeed, the distally extending legs 23 may still be radially outwardly deflected manually by a user, if necessary, in order to remove the collar 3 of the first vial 1*a* from the connecting member 20. The distally extending legs 23 therefore form releasable snap-fitting means for mounting the connecting member onto the collar of the first vial 1*a*.

In a further step, the user then moves the connecting member 20 and the first vial 1*a* mounted thereon in the lateral direction towards the gripping member 30 as shown by arrow F in FIG. 8. At the beginning of the movement, the user may be guided by the proximal ridges 55 of the rigid shell 51 in order to do so.

Figure 9:
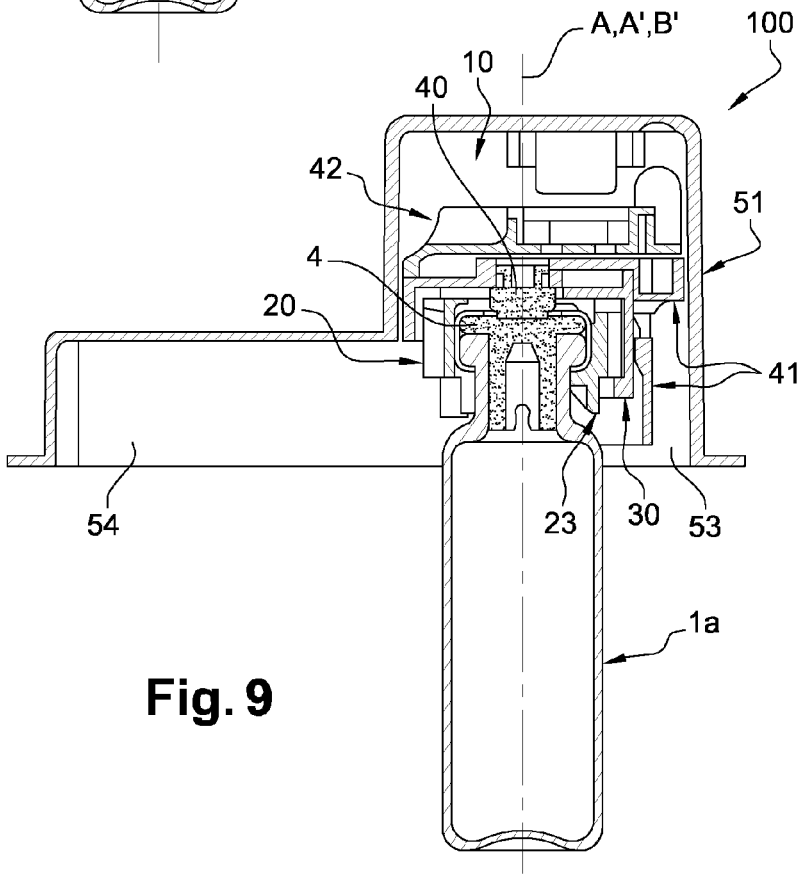
FIG. 9 is a cross section view of the assembly of FIG. 8 with the gripping member mounted on the connecting member.

Since the connecting member 20 is engageable into the gripping member 30, as explained with reference to FIGS. 5A-5C, the gripping member 30 is therefore laterally mounted onto the connecting member 20, as shown in FIG. 9. In addition, thanks to the cooperation of the ridges 27, the transversal surface 28 and the shoulders 29 of the ring 21 with the lateral walls 32*b* and the curved rims 32*c* of the U-shaped body 31, the connecting member 20 and the gripping member 30 are locked in rotation one with respect to the other. Moreover, the cooperation of these engagement means minimizes the impact of manufacturing tolerances and allows a strong and reliable assembly between the connecting member 20 and the gripping member 30. The first vial 1*a* is therefore correctly aligned and secured on the gripping member 30 and, in the example shown, on the elastomeric piece 40, the outer cap 41 and the cover 42 of the adaptor 10. In particular, the elastomeric piece 40 faces the opening of the collar 3, and, on the example shown, the septum 4 closing this opening.

Furthermore, as seen above with respect to FIG. 5C, the distal ends of the distally extending legs 23 of the connecting member 20 are now in abutment and radially blocked by either the radial rims 36 or the front projection 37 of the gripping member 30. Indeed, the distally extending legs 23 may no more be deflected radially outwardly. These distally extending legs 23 also show a very high resistance to breakage, in particular due to this abutment. The radial rims 36 and the front projection 37 of the gripping member 30 therefore form locking means for preventing the release of snap-fitting means formed by the distally extending legs 23. These locking means prevent removal of the first vial 1*a* from the connecting member 20 once the gripping member 30 of the adaptor 10 is mounted onto the connecting member 20. No accidental removal of the vial 1*a* is therefore possible when the vial 1*a* is in use. Furthermore, in embodiments not detailed, the gripping member 30 can be placed in an active state, where it restricts the lateral movement of the connecting member 20. The vial 1*a* is therefore locked into the connecting member 20 by the locking means while the connecting member is locked into the gripping member 30 which is in an active state. The vial 1*a* is thus permanently mounted into the adaptor 10 and the user is ensured that the vial 1*a* has not been tampered. In this embodiment, the adaptor 10 also acts as an anti-tampering means.

Thanks to the presence of the envelope 50 and of the temporary fixing means of the assembly 100 of the invention, the mounting of a first vial 1*a* into the adaptor 10 can be realized in excellent hygienic conditions. Indeed, no direct contact is required between the user's hands and the different elements of the assembly, the user only holding the bottom of the first vial 1*a* in one hand and the rigid shell 50 in the other hand. This is particularly valuable during remote medical programs where hygienic conditions may be challenging.

In order to withdraw a dose of product from the first vial 1*a*, the user then removes the rigid shell 51 from the rest of the assembly 100, namely from the adaptor 10, with its gripping member 30 mounted on the connecting member 20, said connecting member 20 being itself mounted onto the first vial 1*a*. The user then pierces the elastomeric piece 40 and the septum 4 with the needle of an injection device (not shown) and he proceeds to the withdrawal of the dose of a product. This step may be repeated as many times as the number of doses of product present in the first vial 1*a*.

Introducing the needle of an injection device into the first vial 1*a* implies piercing and traversing the elastomeric piece of the adaptor in the first place. During this step, the needle mechanically rubs against the material forming the elastomeric piece and it is cleaned, as potential bacteria are wiped from the needle when said needle penetrates the elastomeric piece. In addition, once the needle protrudes out of the elastomeric piece of the adaptor, it directly enters the septum of a first vial 1*a* and may therefore not be contaminated by foreign elements. In particular thanks to the engagement means and locking means, the first vial 1*a* is correctly positioned into the adaptor 10 and it is not allowed to move relatively from the axis A' through which the needle penetrates the elastomeric piece. The engagement means and locking means therefore help completing a safe dose withdrawal from the first vial 1*a*.

The use of the assembly 100 in connection with a second vial 1*b* of FIGS. 1A-1C with a collar 3 having an outer diameter D2 will now be explained with reference to FIGS. 2-7 and 10-12.

Figure 10:
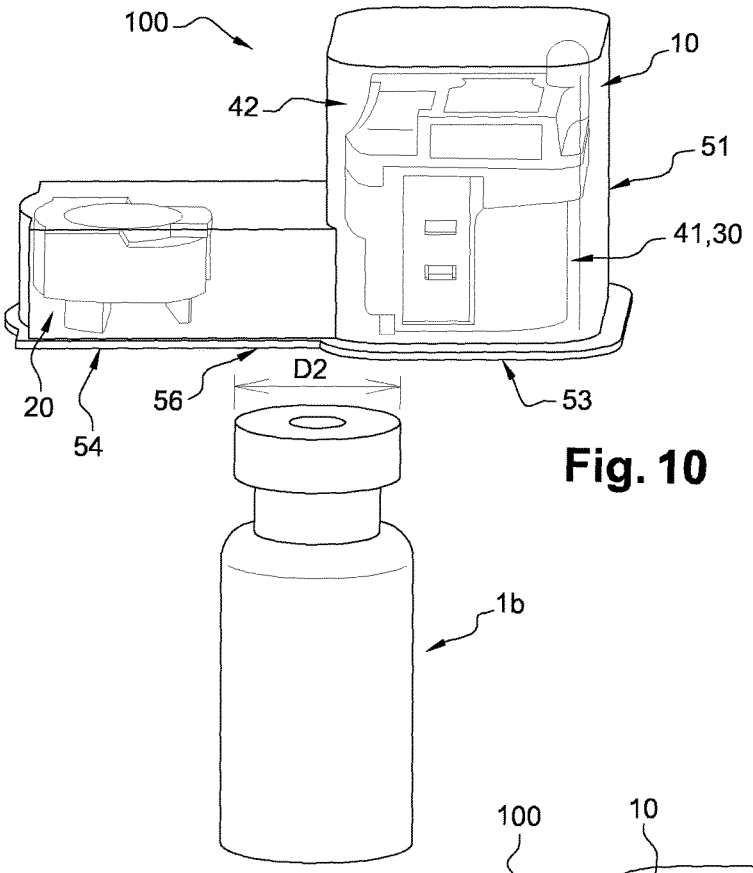
FIG. 10 is a side view showing the step of mounting the adaptor of assembly of FIG. 2 onto a vial of outer diameter D2.
Figure 11:
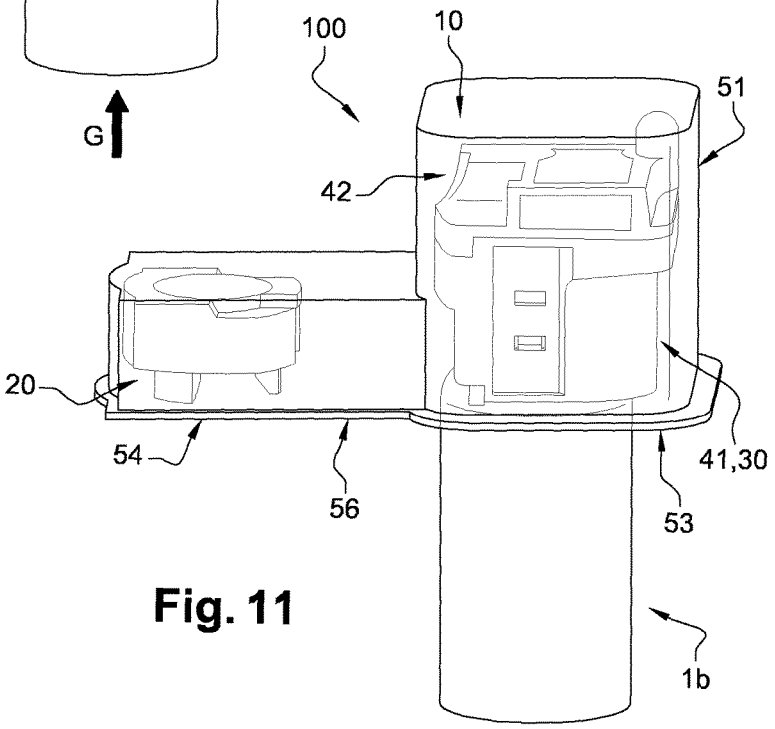
FIG. 11 is a side view showing the step of mounting the adaptor of assembly of FIG. 2 onto a vial of outer diameter D2.

With reference to FIG. 10, once the user has removed the film 52 from the protecting envelope 50, he seizes the second vial 1*b* provided with a collar 3 having an outer diameter D2. The connecting member 20 is still lodged into the front lodging 54 of the rigid shell 51, thanks to the ridges 27 being in distal abutment onto the proximal ridges 55, as explained above in reference to FIG. 7.

The user then directs the collar 3 of the second vial 1*b* in the proximal direction towards the central lodging 56 of the rigid shell 51 as shown by arrow G of FIG. 10. The central lodging 56 is free of any gripping member and its inner wall is free of any ridges. Once the collar 3 of outer diameter D2 has reached the central lodging 56, the user pushes the second vial 1*b* laterally towards the gripping member 30. The gripping member 30 is therefore laterally mounted onto the collar 3 of diameter D2 of the second vial 1*b*, as shown on FIGS. 11 and 12.

Figure 12:
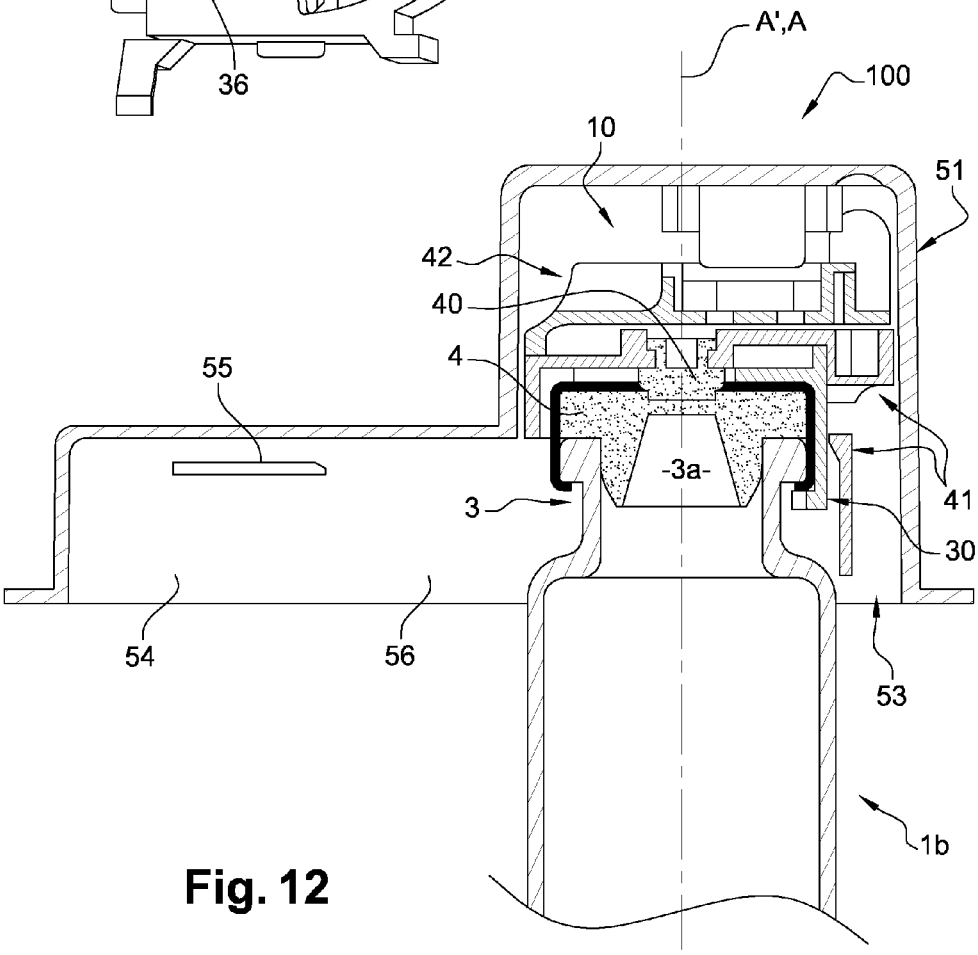
FIG. 12 is a cross section view of the adaptor of FIG. 2 mounted on a vial of outer diameter D2.

As shown on FIG. 12, the connecting member 20 is not in use, but it does not prevent the use of the adaptor 10 with a second vial 1*b* having a collar of outer diameter D2. However, the connecting member 20 may be removed from the rigid shell 51.

The second vial 1*b* is therefore correctly aligned on the gripping member 30 and, in the example shown, on the elastomeric piece 40, outer cap 41 and cover 42 of the adaptor 10. In particular, the elastomeric piece 40 faces the opening of the collar 3, and on the example shown the septum 4 closing this opening.

In order to withdraw a dose of product from the second vial 1*b*, the user then removes the rigid shell 51 from the gripping member 30, elastomeric piece 40, outer cap 41 and over 42. The user then pierces the elastomeric piece 40 and then the septum 4 with the needle of an injection device (not shown) and he proceeds to the withdrawal of the dose of a product. As shown above, during this step, the needle mechanically rubs against the material forming the elastomeric piece and it is cleaned, as potential bacteria are wiped from the needle when said needle penetrates the elastomeric piece. In addition, once the needle protrudes out of the elastomeric piece of the adaptor, it directly enters the septum of the vial 1 and may therefore not be contaminated by foreign elements.

This step may be repeated as many times as the number of doses of product present in the second vial 1*b*.

The assembly of the invention allows securing the same adaptor on two different sorts of medical containers, with different dimensions of collar, such as pharmaceutical vials containing a plurality of doses of vaccines. In particular, these two different medical containers may show collars having different outer diameters. For example, if two sizes of vials for a certain vaccine exist, such as 10-doses vial having a collar with an outer diameter of D1, and 30-doses vial having a collar with an outer diameter of D2, the assembly of the invention allows using these two sizes of vials with the same adaptor, with the same level of safety and stability, and without particular training of the user. A second adaptor, with a gripping member of different size/dimensions is not necessary. The assembly of the invention is therefore particularly useful to simplify the supply-chain of remote medical programs such as immunization, in locations where it is difficult to maintain excellent hygienic conditions.

The invention claimed is:

1. An assembly comprising:

a connecting member adapted to be axially mounted on a first collar defining an opening of a first medical container, said first collar having an outer diameter D1, said connecting member having an axial through hole for access to said opening of said first medical container, said connecting member having an outer diameter D2, wherein D1 is strictly less than D2, an adaptor comprising:

a gripping member capable of being laterally mounted on either said connecting member or on a second collar defining an opening of a second medical container, said second collar having an outer diameter equal to the outer diameter D2 of said connecting member, said gripping member having a central hole for access to said opening of said second medical container, a pierceable elastomeric piece, fixed with respect to said gripping member, arranged so as to face said through hole or central hole when said gripping member is mounted on said connecting member or on said second medical container, a protecting envelope comprising a rigid shell substantially surrounding said connecting member and said adaptor in a storage position of the assembly, in which the connecting member is separate from the adaptor, said rigid shell being closed by a removable film, wherein said assembly further comprises a first engagement portion for engaging said connecting member and preventing said connecting member from escaping from said rigid shell when said film is removed.

2. The assembly according to claim 1, wherein said connecting member and said adaptor are laterally spaced from one another within said shell, and the first engagement portion comprises laterally extending ridges located on an inner wall of said shell and adapted to cooperate with a surface of said connecting member, so that when said removable film is removed, said connecting member is maintained within said shell.

3. The assembly according to claim 1, further comprising a second engagement portion for preventing rotation of said connecting member with respect to said gripping member when said gripping member is mounted on said connecting member.

4. The assembly according to claim 3, wherein said second engagement portion comprises at least one first surface located on an outer wall of the connecting member and at least one corresponding second surface located on an inner wall of the gripping member, said at least one first surface and at least one corresponding second surface being adapted to cooperate with one another to prevent rotation of said connecting member with respect to said gripping member when said gripping member is mounted on said connecting member.

5. The assembly of claim 1, wherein said gripping member is a lateral clipping member comprising a U-shaped element adapted to engage said connecting member or said second collar via an open part of the U-shaped element, a curved part of the U-shaped element partially surrounding said connecting member or second collar.

6. The assembly of claim 1, wherein the connecting member comprises at least one releasable snap-fitting member adapted to cooperate with said first collar so as to mount said connecting member on said first collar.

7. The assembly according to claim 6, further comprising at least one locking member for preventing the release of said at least one snap-fitting member once said gripping member is mounted on said connecting member.

8. The assembly according to claim 7, wherein said at least one locking member is located on said gripping member.

9. The assembly according to claim 1, wherein the elastomeric piece is lodged within a recess on the gripping member.

10. The assembly according to claim 1, wherein said adaptor further comprises an outer cap substantially surrounding said gripping member, and the elastomeric piece is lodged within a recess on the outer cap.

11. A kit comprising an assembly according to claim 1, a first medical container provided with a first collar of outer diameter D1 and a second medical container provided with a second collar of outer diameter D2.

12. A kit according to claim 11, wherein the first collar and the second collar are both closed by a septum.

* * * * *